US005554480A

United States Patent [19]

Patel et al.

[11] Patent Number: 5,554,480

[45] Date of Patent: Sep. 10, 1996

[54] FLUORESCENT TONER PROCESSES

[75] Inventors: Raj D. Patel, Oakville; H. Bruce Goodbrand, Hamilton; Grazyna E. Kmiecik-Lawrynowicz, Burlington; Michael A. Hopper, Toronto; Melvin D. Croucher, St. Catharines; James M. Duff, Mississauga, all of Canada

[73] Assignee: Xerox Corporation, Stamford, Conn.

[21] Appl. No.: 299,392

[22] Filed: Sep. 1, 1994

[51] Int. Cl.[6] ..... G03G 9/087; G03G 9/09

[52] U.S. Cl. ..... 430/137; 430/106; 430/109; 430/111

[58] Field of Search ..... 430/137, 111, 430/106, 109

[56] References Cited

U.S. PATENT DOCUMENTS

| | | | |
|---|---|---|---|
| 4,137,188 | 1/1979 | Uetake et al. | 252/62.1 |
| 4,558,108 | 12/1985 | Alexandru et al. | 526/340 |
| 4,777,108 | 10/1988 | Adair | 430/10 |
| 4,797,339 | 1/1989 | Maruyama et al. | 430/109 |
| 4,865,937 | 9/1989 | Santilli et al. | 430/137 |
| 4,983,488 | 1/1991 | Tan et al. | 430/137 |
| 4,996,127 | 2/1991 | Hasegawa et al. | 430/109 |
| 5,346,797 | 9/1994 | Kmiecik-Lawrynowicz et al. | 430/137 |
| 5,403,693 | 4/1995 | Patel et al. | 430/111 |

FOREIGN PATENT DOCUMENTS

| | | | |
|---|---|---|---|
| 1-126659 | 5/1989 | Japan | 430/106.6 |

OTHER PUBLICATIONS

Xerox Disclosure Journel vol. 17 No. 5 Sep./Oct. 1992 p. 401.

Patent & Trademark Office English Language Translation of Japanese Patent 1–126659 (Pub. May 1989).

*Primary Examiner*—Janis L. Dote
*Attorney, Agent, or Firm*—E. O. Palazzo

[57] ABSTRACT

A process for the preparation of fluorescent toner compositions comprising (i) preparing a pigment dispersion in a solvent, which dispersion is comprised of a pigment or dye, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of pigment, resin particles and charge control agent to form electrostatically bound toner size aggregates; and (iii) heating the statically bound aggregated particles to form said toner composition comprised of polymeric resin, pigment and optionally a charge control agent, and wherein the pigment or dye is excitable by ultraviolet light in the frequency range of from about 254 to about 366 nanometers and fluoresces in the visible spectrum of from about 400 to about 700 nanometers.

29 Claims, No Drawings

FLUORESCENT TONER PROCESSES

BACKGROUND OF THE INVENTION

The present invention is generally directed to toner processes and, more specifically, to aggregation and coalescence processes for the preparation of fluorescent security toner compositions. In embodiments, the present invention is directed to the economical preparation of fluorescent toners without the utilization of the known pulverization and/or classification methods, and wherein toners with an average volume diameter of from about 1 to about 25 and preferably from 1 to about 10 microns, and narrow GSD characteristics can be obtained. The resulting toners can be selected for known electrophotographic imaging and printing processes, including security color processes and lithography. In embodiments, the present invention is directed to a process comprised of dispersing a component, such as a pigment, excited in the ultraviolet region of the light spectrum and which fluoresces in the visible spectral region, such as invisible blue dyes, and optionally a charge control agent or additive in an aqueous mixture containing an ionic surfactant, and shearing this mixture with a latex mixture comprised of suspended resin particles of from about 0.05 micron to about 2 microns in volume diameter, in an aqueous solution containing a counterionic surfactant with opposite charge to the ionic surfactant of the pigment dispersion and nonionic surfactant, thereby causing a flocculation of resin particles, pigment particles and optional charge control particles, followed by stirring of the flocculent mixture, which is believed to form statically bound aggregates of from about 0.5 micron to about 5 microns, comprised of resin, pigment and optionally charge control particles, and thereafter heating to generate toners with an average particle volume diameter of from about 1 to about 25 microns in embodiments, a luminescent dye or pigment is dispersed in an aqueous cationic solution by ultra sonification or microfluidization methods, and the pigment or dye solution iS simultaneously introduced with latex particles into a high shear device containing water, and wherein blending is accomplished at high speeds of, for example, about 7,000 to about 12,000 revolutions per minute, followed by aggregating and coalescing, reference U.S. Pat. Nos. 5,370,963, 5,344,738, 5,403,693, 5,418,108, 5,364,729, and 5,405,728, the disclosures of which are totally incorporated herein by reference. It is believed that during the heating stage, the aggregate particles fuse together to form toners. In embodiments thereof, the present invention is directed to an in situ process comprised of first dispersing a pigment, such as an invisible blue fluorescent dye, in an aqueous mixture containing a cationic surfactant, such as benzalkonium bromide (SANIZOL B-50™), utilizing a high shearing device, such as a Brinkman Polytron, microfluidizer or sonicator; thereafter shearing this mixture with a latex of suspended resin particles, such as PLIOTONE™, comprised of styrene butadiene and of a particle size ranging from 0.01 to about 0.5 micron, as measured by the Brookhaven nanosizer, in an aqueous surfactant mixture containing an anionic surfactant, such as sodium dodecylbenzene sulfonate (for example NEOGEN R™ or NEOGEN SC™), and nonionic surfactant, such as alkyl phenoxy poly(ethylenoxy)ethanol (for example IGEPAL 897™ or ANTAROX 897™), thereby resulting in a flocculation, or heterocoagulation of the resin particles with the pigment particles; which on further stirring results in formation of statically bound or attached aggregates ranging in size of from about 0.5 micron to about 10 microns in average diameter size as measured by the Coulter Counter (Microsizer II); and thereafter, heating to provide for particle fusion or coalescence of the polymer and pigment particles; followed by washing with, for example, hot water,to remove surfactant, and drying whereby toner particles comprised of resin and pigment with various particle size diameters can be obtained, such as from 1 to 12 microns in volume average particle diameter. The aforementioned toners are especially useful for the development of colored images with excellent line and solid resolution, and wherein substantially no background deposits are present. While not being desired to be limited by theory, it is believed that the flocculation or heterocoagulation is formed by the neutralization of the pigment mixture containing the pigment or dye, and cationic surfactant absorbed on the pigment surface with the resin mixture containing the resin particles and anionic surfactant absorbed on the resin particle. The high shearing stage disperses the big initially formed flocculants, and speeds up formation of stabilized aggregates negatively charged and comprised of the pigment and resin particles of about 0.5 to about 5 microns in volume diameter. Thereafter, heating is applied to fuse the aggregated particles or coalesce the particles to toner composites. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by homogenization; and form statically bound aggregate particles by stirring of the homogeneous mixture and toner formation after heating.

SUMMARY OF THE INVENTION

It is an object of the present invention to provide toner processes with many of the advantages illustrated herein. Specifically, the present invention provides a means for the incorporation of water insoluble, visibly fluorescent dyes and pigments into toner particles which circumvents the more costly and energy conventional melt mixing process.

In another object of the present invention there are provided simple and economical processes for the direct preparation of black and colored toner compositions with, for example, excellent pigment dispersion and narrow GSD, and wherein the pigment is excited in the UV portion of the light spectrum, that is from about 254 to about 366 nanometers.

In another object of the present invention, there are provided simple and economical in situ processes for black and colored toner compositions by an aggregation process comprised of (i) preparing a cationic pigment mixture containing invisible dye or pigment particles, and optionally charge control agents and other known optional additives dispersed in water containing a cationic surfactant by shearing, microfluidizing or ultrasonifying; (ii) shearing the pigment mixture with a latex mixture comprised of a polymer resin, anionic surfactant and nonionic surfactant thereby causing a flocculation or heterocoagulation, which on further stirring allows the formation of electrostatically stable aggregates of from about 0.5 to about 5 microns in volume diameter as measured by the Coulter Counter; and (iii) coalescing or fusing the aggregate particle mixture by heat to toner composites, or a toner composition comprised of resin, pigment, and charge additive.

In a further object of the present invention there is provided a process for the preparation of toners with an average particle diameter of from between about 1 to about 50 microns, and preferably from about 1 to about 7 microns, and with a narrow GSD of from about 1.2 to about 1.35 and preferably from about 1.2 to about 1.3 as measured by the Coulter Counter.

Moreover, in a further object of the present invention there is provided a process for the preparation of toners which after fixing to paper substrates results in images with gloss of from 20 GGU up to 70 GGU as measured by Gardner Gloss meter matching of toner and paper.

In another object of the present invention there are provided composite polar or nonpolar toner compositions in high yields of from about 90 percent to about 100 percent by weight of toner without resorting to classification.

In yet another object of the present invention there are provided toner compositions with low fusing temperatures of from about 110° C. to about 150° C., and with excellent blocking characteristics at from about 50° C. to about 60° C.

Moreover, in another object of the present invention there are provided toner compositions with high projection efficiency such as from about 75 to about 95 percent efficiency as measured by the Match Scan II spectrophotometer available from Milton-Roy.

In a further object of the present invention there are provided toner compositions which result in low or no paper curl.

Another object of the present invention resides in processes for the preparation of small sized toner particles with narrow GSDs, and excellent pigment dispersion by the aggregation of latex particles, or the aggregation of MICR suspension particles with pigment particles dispersed in water and surfactant, and wherein the aggregated particles of toner size can then be caused to coalesce by, for example, heating. In embodiments, factors of importance with respect to controlling particle size and GSD include the concentration of the surfactant used for the pigment dispersion, concentration of the component like acrylic acid in the latex, the temperature of coalescence, and the time of coalescence.

These and other objects of the present invention are accomplished in embodiments by the provision of fluorescent toners and authentication processes thereof. In embodiments of the present invention, there are provided processes for the economical direct preparation of fluorescent toner compositions by a flocculation or heterocoagulation, and coalescence processes.

In embodiments, the present invention is directed to processes for the preparation of toner compositions, which comprise initially attaining or generating an ionic pigment dispersion by, for example, dispersing an aqueous mixture of an invisible dye, pigment or pigments wherein the pigment, pigments, or dye are excitable by ultraviolet light in the frequency range of from about 254 to about 366 nanometers and fluoresce in the visible spectrum of from about 400 to about 700 nanometers, such as quinacridone type components with a cationic surfactant, such as benzalkonium chloride, by utilizing a high shearing device, such as a Brinkman Polytron, thereafter shearing this mixture by utilizing a high shearing device such as a Brinkman Polytron, or sonicator or microfluidizer with a suspended resin mixture comprised of polymer particles such as styrene butadiene or styrene butylacrylate and of particle size ranging from 0.01 to about 0.5 micron in an aqueous surfactant mixture containing an anionic surfactant, such as sodium dodecylbenzene sulfonate, and a nonionic surfactant resulting in a flocculation or heterocoagulation of the resin particles with the pigment particles caused by the neutralization of cationic surfactant absorbed on the pigment with the oppositely charged anionic surfactant absorbed on the resin particles; and further stirring the mixture using a mechanical stirrer at 250 to 500 rpm and allowing the formation of electrostatically stabilized aggregates ranging from about 0.5 micron to about 10 microns in volume average diameter; and heating from about 60° to about 95° C. to provide for particle fusion or coalescence of the polymer and pigment particles; followed by washing with, for example, hot water to remove surfactant, and drying such as by use of an Aeromatic fluid bed dryer whereby toner particles comprised of resin and pigment with various particle size diameters can be obtained, such as from about 1 to about 10 microns in volume average particle diameter as measured by the Coulter Counter.

In embodiments of the present invention, there are also provided emulsion aggregation coalescent processes wherein the surfactant selected for the preparation of the pigment dispersion is an anionic surfactant, and the counterionic surfactant present in the latex mixture is a cationic surfactant; the dispersion of step (i) is accomplished by homogenizing at from about 1,000 revolutions per minute to about 10,000 revolutions per minute at a temperature of from about 25° C. to about 35° C. and for a duration of from about 1 minute to about 120 minutes; the dispersion of step (i) is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes, or wherein the dispersion of step (i) is accomplished by microfluidization in a microfluidizer or in a nanojet for a duration of from about 1 minute to about 120 minutes; the homogenization of step (ii) is accomplished by homogenizing at from about 1,000 revolutions per minute to about 10,000 revolutions per minute, and for a duration of from about 1 minute to about 120 minutes; the heating of the statically bound aggregate particles forms toner size composite particles comprised of pigment, resin particles and optional charge control agent is accomplished at a temperature of from about 60° C. to about 95° C. for a duration of from about 1 hour to about 8 hours; the resin particles are selected from the group consisting of poly(styrene-butadiene-acrylic acid), poly(styrene-butadiene-methacrylic acid), poly(styrene-butyl methacrylate-acrylic acid), or poly(styrene-butyl acrylate-acrylic acid); PLIOTONE™, a styrene butadiene, polyethyleneterephthalate, polypropylene-terephthalate, polybutylene-terephthalate, polypentylene-terephthalate, polyhexalene-terephthalate, polyheptadeneterephthalate, and polyoctalene-terephthalate; the cationic surfactant is a quaternary ammonium salt; the fluorescent pigment is initially invisible, and subsequently rendered visible by subjecting it to ultraviolet light, and has a volume average diameter from about 0.01 to about 3 microns; the toner particles isolated are from about 3 to about 15 microns in volume average diameter, and the geometric size distribution is from about 1.15 to about, 1.35; the statically bound aggregate particles formed in step (iii) are from about 1 to about 10 microns in volume average diameter; the nonionic surfactant concentration is about 0.1 to about 5 weight percent of the toner component; the toner is washed with warm water and the surfactants are removed from the toner surface, followed by drying; the solvent is water; a process for the preparation of fluorescent toner compositions comprising:

(i) preparing a pigment dispersion, which dispersion is comprised of a pigment or dye, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below the glass transition temperature (Tg) of the resin to form electrostatically bound toner size aggregates with a narrow particle size distribution; and (iv) heating said bound aggregates above the Tg of the resin and wherein the pigment or dye is excitable by ultraviolet light in the frequency range of from about 254 to about 366 nanometers, and fluoresces in the visible spectrum of from about 400 to about 700 nanometers; the temperature below the resin Tg of (iii) enables the size of the aggregated particles to be in the range of from about 2.5 to about 10 microns in volume average diameter; the size of said aggregates can be increased to from about 2.5 to about 10 microns by increasing the temperature of heating in (iii) to from about room temperature to about 50° C.; a process for the preparation of fluorescent toner compositions with controlled particle size comprising:

(i) preparing a pigment dispersion in water, which dispersion is comprised of a pigment or dye of a diameter of from about 0.01 to about 1 micron, and an ionic surfactant;

(ii) shearing the pigment dispersion with a latex blend comprised of resin of submicron size of from about 0.01 to about 1 micron, a counterionic surfactant with a charge polarity of opposite sign to that of said ionic surfactant and a nonionic surfactant thereby causing a flocculation or heterocoagulation of the formed particles of pigment and resin to form a uniform dispersion of solids in the water and surfactant;

(iii) heating the above sheared blend at a temperature of from about 5° to about 20° C. below the Tg of the resin to form electrostatically bound toner size aggregates with a narrow particle size distribution;

(iv) heating the statically bound aggregated particles at a temperature of from about 5° to about 50° C. above the Tg of the resin to provide a mechanically stable toner composition comprised of polymeric resin and pigment; and optionally (v) separating the toner particles; and (vi) drying the toner particles, and wherein the pigment or dye is excitable by ultraviolet light in the frequency range of from about 254 to about 366 nanometers and fluoresces in the visible spectrum of from about 400 to about 700 nanometers; a process for the preparation of fluorescent toner compositions comprising:

(i) preparing a pigment dispersion in water, which dispersion is comprised of a pigment or dye and an ionic surfactant;

(ii) shearing the pigment dispersion with a latex blend comprised of resin of submicron size, a counterionic surfactant with a charge polarity of opposite sign to that of the ionic surfactant and a nonionic surfactant thereby causing a flocculation or heterocoagulation of the formed particles of pigment, resin and charge control agent to form a uniform dispersion of solids in the water and surfactant;

(iii) heating the above sheared blend below or about equal to the glass transition temperature (Tg) of the resin to form electrostatically bound toner size aggregates with a narrow particle size distribution;

(iv) heating the statically bound aggregated particles above or about equal to the Tg of the resin particles to provide a toner composition comprised of resin; followed by optionally (v) separating the toner particles from said water by filtration; and (vi) drying the toner particles, and wherein the pigment or dye is excitable by ultraviolet light in the frequency range of 254 to 366 nanometers, and fluoresces in the visible spectrum of 400 to 700 nanometers; the resin Tg is 54° C. and heating in (iv) is from about 59° C. to about 104° C.; the resin Tg in (iii) is from about 52° to about 65° C.; and the resin Tg in (iv) is from about 52° C. to about 65° C.; the heating in (iii) is equal to or slightly above the resin Tg; and the heating in (iv) is equal to or slightly above the resin Tg.

Embodiments of the present invention include a process for the preparation of toner compositions or toner particles comprising (i) preparing a dye or pigment dispersion in a solvent, which dispersion is comprised of a pigment, an ionic surfactant and optionally a charge control agent; and wherein the pigment or dye emits light in response to excitation by ultraviolet radiation in the wavelength range of from about 256 to about 366 nanometers, and fluoresces in the visible region of the light spectrum, that is at wavelengths of from about 400 to about 700 nanometers;

(ii) shearing the pigment dispersion with a latex mixture comprised of a counterionic surfactant with a charge polarity of opposite sign to that of ionic surfactant of (i), a nonionic surfactant and resin particles, thereby causing a flocculation or heterocoagulation of the formed particles of pigment, resin and charge control agent to form electrostatically bound or bounded toner size aggregates;

(iii) heating the statically bound aggregated particles to form a toner composition comprised of polymeric resin, pigment and optionally a charge control agent; and thereafter optionally cooling the toner particles formed.

Also, in embodiments the present invention is directed to processes for the preparation of toner compositions which comprise (i) preparing an ionic pigment mixture by dispersing a pigment or dye excitable by ultraviolet light, such as 4,4'-bis(styryl)biphenyl, 2-(4-phenylstilben- 4-yl)-6-t-butylbenzoxazole, β-methylumbelliferone, 4-methyl-7-dimethylaminocoumarin, 4-methyl-7-aminocoumarin, N-methyl-4-methoxy-1,8-naphthalimide, 9,10-bis(phenethynyl)anthracene, 5,12-bis(phenethynyl) naphthacene, or DAYGLO INVISIBLE BLUE™ A-594-5, of from about 2 to about 10 percent by weight of the toner in an aqueous mixture containing a cationic surfactant, such as dialkylbenzene dialkylammonium chloride like SANIZOL B-50™ available from Kao Chemicals or MIRAPOL™ available from Alkaril Chemicals, of from about 0.5 to about 2 percent by weight of water, utilizing a high shearing device, such as a Brinkman Polytron or IKA homogenizer, at a speed of from about 3,000 revolutions per minute to about 10,000 revolutions per minute for a duration of from about 1 minute to about 120 minutes; (ii) adding the aforementioned ionic pigment mixture to an aqueous suspension of resin particles comprised of, for example, styrene methacrylate, PLIOTONE™ or styrene butadiene of from about 88 percent to about 98 percent by weight of the toner, and of about 0.1 micron to about 3 microns polymer particle size in volume average diameter, and counterionic surfactant, such as an anionic surfactant such as sodium dodecylsulfate, dodecylbenzenesulfonate or NEOGEN R™, of from about 0.5 to about 2 percent by weight of water, a nonionic surfactant, such as polyethylene glycol or polyoxyethytene glycol nonyl phenyl ether or IGEPAL 897™ obtained from GAF Chemical Company, of from about 0.5 to about 3 percent by weight of water, thereby causing a flocculation or heterocoagulation of pigment, charge control additive and resin particles; (iii) homogenizing the resulting flocculent mixture with a high shearing device such as a Brinkman Polytron or IKA homogenizer at a speed of from about 3,000 revolutions per minute to about 10,000 revolutions per minute for a duration of from about 1 minute to about 120 minutes, thereby resulting in a homogeneous mixture of latex and pigment and further stirring with a mechanical stirrer from about 250 to 500 rpm to form electrostatically stable aggregates of from about 0.5 micron to about 5 microns in volume average diameter; (iv) diluting the aggregate particle mixture with water from about 50 percent solids to about 15 percent solids; (v) heating the statically bound aggregate composite particles at from about 60° C. to about 95° C. and for a duration of about 60 minutes to about 600 minutes to form toner sized particles of from about 3 microns to about 7 microns in volume average diameter and with a geometric size distribution of from about 1.2 to about 1.4 as measured by the Coulter. Counter; and (vi) cooling and isolating the toner sized particles by washing, filtering and drying thereby providing a composite toner composition. Flow additives to improve flow characteristics and charge additives to improve charging characteristics may then optionally be adding by blending with the toner, such additives including AEROSILS® or silicas, metal oxides like tin, titanium and the like, of from about 0.1 to about 10 percent by weight of the toner.

One preferred method of obtaining a pigment dispersion depends on the form of the pigment utilized. In some instances, pigments are available in the wet cake or concentrated form containing water; they can be easily dispersed utilizing a homogenizer or stirring. In other instances, pigments are available in a dry form, whereby dispersion in water is effected by microfluidizing using, for example, a M-110 microfluidizer and passing the pigment dispersion from 1 to 10 times through the chamber, or by sonication, such as using a Branson 700 sonicator, with the optional addition of dispersing agents such as the aforementioned ionic or nonionic surfactants.

Illustrative examples of resin or resin particles selected for the process of the present invention include known polymers such as poly(styrene-butadiene), poly(para-methyl styrene-butadiene), poly(metamethyl styrene-butadiene), poly(alpha-methyl styrene-butadiene), poly(methylmethacrylate-butadiene), poly(ethylmethacrylate-butadiene), poly(propylmethacrylate-butadiene), poly(butytmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(metamethyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene), terpolymers, such as poly(styrene-butadiene-acrylic acid), poly(styrene-butadiene-methacrylic acid), PLIOTONE™, a styrene/butadiene copolymer, available from Goodyear, polyethylene-terephthalate, polypropylene-terephthalate, polybutyleneterephthalate, polypentylene-terephthalate, polyhexalene-terephthalate, polyheptadene-terephthalate, polyoctalene-terephthalate, POLYLITE™, a polyester resin (Reichhold Chemical Inc), PLASTHALL™, a polyester, (Rohm & Hass), CYGLAS™, a polyester molding compound (American Cyanamide), ARMCO™, a polyester (Armco Composites), ARPOL™ (Ashland Chemical), CELANEX™, a glass reinforced thermoplastic polyester, (Celanese Eng), RYNITE™, a thermoplastic polyester, (DuPont), and STYPOL™, a polyester with styrene monomer, (Freeman Chemical Corporation). The resin particles selected, which generally can be in embodiments styrene acrylates, styrene butadienes, styrene methacrylates, or polyesters, are present in various effective amounts, such as from about 70 weight percent to about 98 weight percent of the toner, and can be of small average particle size, such as from about 0.01 micron to about 1 micron in volume average diameter as measured by the Brookhaven nanosize particle analyzer. Other effective amounts of resin can be selected.

The resin particles selected for the process of the present invention are preferably prepared from emulsion polymerization techniques, and the monomers utilized in such processes can be selected from the group consisting of styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups is optional and such groups can be present in various amounts of from about 0.1 to about 10 percent by weight of the polymer resin. Known chain transfer agents, such as dodecanethiol or carbontetrachloride, can also be selected when preparing resin particles by emulsion polymerization. Other processes of obtaining resin particles of from about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

Various known second nonfluorescing colorants or pigments can also be present in the toner in an effective amount of, for example, from about 1 to about 25 percent by weight of the toner, and preferably in an amount of from about 1 to about 15 weight percent, including Mobay magnetites MO8029™, MO8060™; Columbian magnetites; MAPICO BLACKS™ and surface treated magnetites; Pfizer magnetites, CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and other equivalent black pigments. As colored pigments there can be selected known cyan, magenta, yellow, red, green, brown, blue or mixtures thereof. Specific examples of pigments include PIGMENT RED 48™, E.D. TOLUIDINE RED™ and BON RED C™ available from Dominion Color Corporation, Ltd., Toronto, Ontario, HOSTAPERM PINK E™, FANAL PINK™ from Hoechst, and CINQUASIA MAGENTA™ available from E. I. DuPont de Nemours & Company, QUINDO MAGENTA™, LITHOL RED™, RHODOMINE YS™ from Sun Chemicals, and the like. Generally, second colored pigments that can be selected are magenta, and highlight color of the magnets and the red such as those of the LITHOL SCARLET™ and Hostafine Red family. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, and the like.

Surfactants in effective amounts of, for example, 0.1 to about 25 weight percent in embodiments include, for example, nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethytene octyl ether, polyoxyethytene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is, for example, from about 0.01 to about 10 percent by weight, and preferably from about 0.1 to about 5 percent by weight of monomers used to prepare the copolymer resin.

Examples of anionic surfactants selected include, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ from Kao, and the like. An effective concentration of the anionic surfactant generally employed is, for example, from about 0.01 to about 10 percent by weight, and preferably from about 0.1 to about 5 percent by weight of monomers used to prepare the copolymer resin.

Examples of the cationic surfactants selected for the toners and processes of the present invention are, for example, dialkyl benzenealkyl ammonium chloride, lauryl trimethyl ammonium chloride, alkytbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyt ammonium chloride, MIRAPOL™ and ALKAQUAT™ available from Alkaril Chemical Company, Sanizol™ (benzalkonium chloride), available from Kao Chemicals, and the like, and mixtures thereof. The surfactant is utilized in various effective amounts, such as for example from about 0.1 percent to about 5 percent by weight of water. Preferably, the molar ratio of the cationic surfactant used for flocculation to the anionic surfactant used in latex preparation is in range of 0.5 to 4, preferably from 0.5 to 2.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent, which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 1 percent toner concentration.

Percentage amounts of components are based on the total toner components unless otherwise indicated.

The following Examples are being submitted to further define various species of the present invention. These Examples are intended to be illustrative only and are not intended to limit the scope of the present invention. Also, parts and percentages are by weight unless otherwise indicated.

GENERAL EXAMPLE

Preparation of the Toner Resin:

Emulsion (latex) or microsuspension particles selected for the preparation of toner particles in embodiments of the aggregation process of the present invention were prepared as follows:

Latex A:

328 Grams of styrene, 72 grams of butyl acrylate, 8 grams of acrylic acid, and 12 grams of dodecane thiol were mixed with 500 milliliters of deionized water in which 9 grams of sodium dodecyl benzene sulfonate anionic surfactant (NEOGEN R™ which contains 60 percent of active component), and 8.5 grams of polyoxyethylene nonyl phenyl ether nonionic surfactant (ANTAROX 897™—70 percent active) were added. 4 Grams of ammonium persulfate initiator were dissolved in 100 milliliters. The emulsion was then polymerized at 80° C. for 6 hours. A latex containing 40 percent solids of styrene/butylacrylate/acrylic acid in the ratio of 82:18:2 pph (parts per hundred) with a particle size of 225 nanometers, as measured on a Brookhaven nanosizer, was obtained. Tg=52° C., as measured on DuPont DSC; $M_w$=22,000 and $M_n$=7,000 as determined on Hewlett Packard GPC.

Latex B:

328 Grams of styrene, 72 grams of butyl acrylate, 8 grams of acrylic acid, and 12 grams of dodecane thiol were mixed with 500 milliliters of deionized water to which were added 9 grams of sodium dodecyl benzene sulfonate anionic surfactant (NEOGEN R™ which contains 60 percent of active component), and 8.5 grams of polyoxyethylene nonyl phenyl ether nonionic surfactant (ANTAROX 897™—70 percent active). 4 Grams of ammonium persulfate initiator were dissolved in 100 milliliters. The emulsion was then polymerized at 70° C. for 6 hours. A latex containing 40 percent solids of styrene/butylacrylate/acrylic acid in the ratio of 82:18:2 pph with a particle size of 225 nanometers, as measured on a Brookhaven nanosizer, was obtained. Tg=55° C., as measured on DuPont DSC; $M_w$=31,000 and $M_n$=5,800 as determined on Hewlett Packard GPC.

Latex C:

350 Grams of styrene, 8 grams of acrylic acid, and 12 grams of dodecane thiol were mixed and charged in a pressure container, to which 50 grams of butadiene was introduced into. This organic phase was then charged (under pressure of approximately 300 Kpa)into a reactor containing the aqueous surfactant phase comprised of 600 milliliters of deionized water, 9 grams of sodium dodecyl benzene sulfonate anionic surfactant (NEOGEN R™ which contains 60 percent of active component), 8.5 grams of polyoxyethylene nonyl phenyl ether nonionic surfactant (ANTAROX 897™—70 percent active) and 4 grams of ammonium persulfate initiator. The emulsion was then polymerized at 80° C. for 6 hours. A latex containing 40 percent solids of styrene/butadiene/acrylic acid in the ratio of 87.5:12.5:2 pph (parts per hundred) with a particle size of 225 nanometers, as measured on Brookhaven nanosizer, was obtained. Tg=54° C., as measured on DuPont DSC; $M_w$=32,000 and $M_n$=9,000 as determined on Hewlett Packard GPC.

PREPARATION OF TONER PARTICLES:

EXAMPLE I 6.7 Grams of dry INVISIBLE BLUE™ pigment, A-595-5 obtained from Dayglo Corporation, and excitable by ultraviolet light in the frequency range of from about 254 to about 366 nanometers and fluoresces in the visible spectrum of from about 400 to about 700 nanometers was dispersed in 200 milliliters of deionized water containing 1.46 gram of alkylbenzyldimethyl ammonium chloride cationic surfactant (SANIZOL B™) using an ultrasonic probe for 2 minutes. The pigment solution was then added to 300 grams of water containing 1.46 grams of cationic surfactant and stirred. This cationic dispersion of the pigment was then simultaneously added with 325 grams of Latex A to 300 grams of water while being homogenized with an IKA G45M probe for 3 minutes at 7,000 rpm. This mixture then was transferred into a reaction kettle and its temperature increased to 45° C. for a period of 1 hour. The particle size of the aggregate obtained was 5.3 microns with a GSD of 1.20 as measured by Coulter Counter. 60 Milliliters of 20 percent (WAN) anionic surfactant solution was then added to the aggregates, after which the reactor temperature was raised to 80° C. for 5 hours to complete the coalescence of the aggregates. The final particle size obtained was 5.3 microns with a GSD of 1.22. The particles were then washed with deionized water and freeze dried. The dry particles were then illuminated under ultraviolet light at 254 nanometers and luminescence was observed.

EXAMPLE II 5.2 Grams of dry INVISIBLE BLUE™ pigment, and 16 grams (40 percent solids) of QUINDO MAGENTA™ wet dispersion were added to 240 milliliters of deionized water containing 2.8 grams of alkylbenzyldimethyl ammonium chloride cationic surfactant (SANIZOL B™) and roll milled for 20 minutes. This cationic dispersion of the pigment was then simultaneously added with 260 grams of Latex B to 400 grams of water while being homogenized with an IKA G45M probe for 3 minutes at 7,000 rpm. This mixture then was transferred into a reaction kettle and its temperature raised to 45° C. for a period of 1 hour. The particle size of the aggregate obtained was 4.8 microns with a GSD of 1.20 as measured by Coulter Counter. 60 Milliliters of 20 percent (W/W) anionic surfactant solution were added to the aggregates, after which the reactor temperature was raised to 85° C. for 5 hours to complete the coalescence of the aggregates. The toner particle size obtained was 5.0 microns with a GSD of 1.21. The particles were then washed with deionized water and freeze dried. The dry particles were then illuminated at 254 nanometers under ultraviolet light and luminescence was observed.

EXAMPLE III

A toner was prepared by the process of Example II with the exception that there was selected as the latex, Latex C, and similar results were observed.

EXAMPLE IV 5.2 Grams of dry INVISIBLE BLUE™ pigment obtained from Dayglo Corporation, and 15 grams (44 percent solids) of LITHOL RUBIN™ wet dispersion obtained from Sun Chemicals were added to 240 milliliters of deionized water containing 2.8 grams of alkylbenzyldimethyl ammonium chloride cationic surfactant (SANIZOL B™) and rolled milled for 20 minutes. This cationic dispersion of the pigment was then simultaneously added with 260 grams of Latex A to 400 grams of water while being homogenized with an IKA G45M probe for 3 minutes at 7,000 rpm. This mixture then was transferred into a reaction kettle and its temperature raised to 45° C. for a period of 1.5 hour. The particle size of the aggregate obtained was 5.5 microns with a GSD of 1.22 as measured by Coulter Counter. 60 Milliliters of 20 percent (W/W) anionic surfactant solution were added to the aggregates, after which the reactor temperature was raised to 90° C. for 4 hours to complete the coalescence of the aggregates. The final particle size obtained was 5.8 microns with a GSD of 1.22. The particles were then washed with deionized water and freeze dried. The dry particles were then illuminated under ultraviolet light at 254 nanometers and luminescence was observed.

EXAMPLE V 5.2 Grams of dry INVISIBLE BLUE™ pigment, and 14.6 grams (46 percent solids) of RHODAMINE YS™ wet dispersion obtained from Sun Chemicals were added to 240 milliliters of deionized water containing 2.8 grams of alkylbenzyldimethyl ammonium chloride cationic surfactant (SANIZOL B™) and rolled milled for 20 minutes. This cationic dispersion of the pigment was then simultaneously added with 260 grams of Latex 13 to 400 grams of water while being homogenized with an IKA G45M probe for 3 minutes at 7,000 rpm. This mixture then was transferred into a reaction kettle and its temperature raised to 45° C. for a period of 1.5 hour. The particle size of the aggregate obtained was 4.9 microns with a GSD of 1.19 as measured by Coulter Counter. 60 Milliliters of 20 percent (W/W) anionic surfactant solution were added to the aggregates, after which the reactor temperature was raised to 90° C. for 4 hours to complete the coalescence of the aggregates. The final particle size obtained was 5.1 microns with a GSD of 1.20. The particles were then washed with deionized water and freeze dried. The dry particles were then illuminated under ultraviolet light at 254 nanometers and luminescence was observed.

EXAMPLE VI 5.2 Grams of dry INVISIBLE BLUE™ pigment, and 8 grams of dry FANAL PINK™ pigment were added to 240 milliliters of deionized water containing 2.8 grams of alkylbenzyldimethyl ammonium chloride cationic surfactant (SANIZOL B™) and sonified for 2 minutes. This cationic dispersion of the pigment was then simultaneously added with 260 grams of Latex C to 400 grams of water while being homogenized with an IKA G45M probe for 3 minutes at 7,000 rpm. This mixture then was transferred into a reaction kettle and its temperature raised to 45° C. for a period of 90 minutes. The particle size of the aggregate obtained was 4.5 microns with a GSD of 1.18 as measured by Coulter Counter. 60 Milliliters of 20 percent (W/W) anionic surfactant solution were added to the aggregates, after which the reactor temperature was raised to 90° C. for 4 hours to complete the coalescence of the aggregates. The final particle size obtained was 4.8 microns with a GSD of 1.20. The particles were then washed with deionized water and freeze dried. The dry particles were then illuminated under ultraviolet light at 254 nanometers and luminescence was observed.

EXAMPLE VIII 5.2 Grams of dry INVISIBLE BLUE™ pigment, and 14 grams (53 percent solids)of wet cake of HOSTAPERM PINK™ pigment obtained from BASF Chemicals were added to 240 milliliters of deionized water containing 2.8 grams of alkylbenzyldimethyl ammonium chloride cationic surfactant (SANIZOL B™) and sonified for 2 minutes. This cationic dispersion of the pigment was then simultaneously added with 260 grams of Latex A to 400 grams of water while being homogenized with an IKA G45M probe for 3 minutes at 7,000 rpm. This mixture then was transferred into a reaction kettle and its temperature raised to 45° C. for a period of 90 minutes. The particle size of the aggregate obtained was 4.9 microns with a GSD of 1.23 as measured by Coulter Counter. 60 Milliliters of 20 percent (W/W) anionic surfactant solution were added to the aggregates, after which the reactor temperature was raised to 90° C. for 4 hours to complete the coalescence of the aggregates. The final particle size obtained was 5.3 microns with a GSD of 1.25. The particles were then washed with deionized water and freeze dried. The dry particles were then illuminated under ultraviolet light at 254 nanometers and luminescence was observed.

EXAMPLE VIII 6.5 Grams of a wet cake of HOSTAPERM PINK™ pigment obtained from Sun Chemicals were dispersed in 60 milliliters of water by an ultrasonic probe for 1 minute. This dispersion was homogenized using a Brinkman probe (20 millimeters), while 60 milliliters of emulsion A (anionic) were added. After 10 minutes of polytroning, 0.2 gram of cationic surfactant was added while still shearing. The resulting "whipped cream" was then diluted with 120 milliliters of water. After 24 hours stirring at room temperature, the kettle contents were heated up to 75° C. for two hours to coalesce the particles. Toner sized particles of 5.1 with GSD=1.39 (as measured on the Coulter Counter) were obtained. Those particles comprised of styrene (88 parts), butyl acrylate (12 parts), acrylic acid (2 parts), and quinacridone magenta pigment (10 percent by weight of toner) had a Tg=73° C. (DSC measurement), a $M_w$=43,000 and a $M_n$=12,500 (measured on GPC). The yield of toner particles was 96 percent.

Toner yields with the prior art processes were 60 percent or less, reference for example U.S. Pat. Nos. 4,996,127 and 4,797,339; and with these processes classification was needed to obtain, for example, desirable GSD.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of fluorescent toner compositions consisting essentially of (i) preparing a pigment dispersion mixture in a solvent, which dispersion is comprised of a first fluorescent pigment and a second colored nonfluorescent pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of first fluorescent pigment and second colored nonfluorescent pigment, resin particles and optionally a charge control agent to form electrostatically bound toner size aggregates; and (iii) heating the electrostatically bound toner sized aggregates to form said toner compositions comprised of resin particles, said first pigment and said second pigment and optionally a charge control agent, and wherein the first fluorescent pigment is excitable by ultraviolet light in the frequency range of from about 254 to about 366 nanometers and fluoresces in the visible spectrum of from about 400 to about 700 nanometers, and wherein the first fluorescent pigment is selected from the group consisting of 4,4'-bis(styryl) biphenyl, 2-(4-phenylstilben-4-yl) 6-butylbenzoxazole, β-methylumbelliferone, 4-methyl-7-dimethylaminocoumarin, 4-methyl-7-aminocoumarin, N-methyl-4-methoxy-1,8-naphthalimide, 9,10-bis(phenethynyl)anthracene, and 5,12-bis(phenethynyl)naphthacene, and the second colored nonfluorescent pigment is selected from the group consisting of magnetite, cyan, magenta, and yellow pigments.

2. A process in accordance with claim 1 wherein the surfactant utilized in preparing the pigment dispersion is a cationic surfactant, and the counterionic surfactant present in the latex mixture is an anionic surfactant.

3. A process in accordance with claim 2 wherein the cationic surfactant is a quaternary ammonium salt.

4. A process in accordance with claim 1 wherein the surfactant selected for the preparation of the pigment dispersion is an anionic surfactant, and the counterionic surfactant present in the latex mixture is a cationic surfactant.

5. A process in accordance with claim 1 wherein the dispersion of step (i) is accomplished by homogenizing at from about 1,000 revolutions per minute to about 10,000 revolutions per minute at a temperature of from about 25° C. to about 35° C. and for a duration of from about 1 minute to about 120 minutes.

6. A process in accordance with claim 1 wherein the dispersion of step (i) is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes, or wherein the dispersion of step (i) is accomplished by microfluidization in a microfluidizer or in a nanojet for a duration of from about 1 minute to about 120 minutes.

7. A process in accordance with claim 1 wherein the shearing of step (ii) is accomplished by homogenizing at from about 1,000 revolutions per minute to about 10,000 revolutions per minute, and for a duration of from about 1 minute to about 120 minutes.

8. A process in accordance with claim 1 wherein the heating of said electrostatically bound toner sized aggregates forms toner compositions comprised of said first pigment and said second pigment, resin particles and optional charge control agent and which heating is accomplished at a temperature of from about 60° C. to about 95° C. for a duration of from about 1 hour to about 8 hours.

9. A process in accordance with claim 1 wherein the resin particles are selected from the group consisting of poly(styrene-butadiene), poly(para-methyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene).

10. A process in accordance with claim 1 wherein the resin particles are selected from the group consisting of poly(styrene-butadiene-acrylic acid), poly(styrene-butadiene-methacrylic acid), poly(styrene-butyl methacrylate-acrylic acid), poly(styrene-butyl acrylate-acrylic acid) polyethylene-terephthalate, polypropylene-terephthalate, polybutylene-terephthalate, polypentylene-terephthalate, polyhexalene-terephthalate, polyheptadene-terephthalate, and polyoctalene-terephthalate.

11. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxymethyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

12. A process in accordance with claim 1 wherein the ionic surfactant is selected from the group consisting of sodium dodecyl sulfate, sodium dodecylbenzene sulfate and sodium dodecylnaphthalene sulfate.

13. A process in accordance with claim 1 wherein the first fluorescent pigment is initially invisible, and subsequently rendered visible by subjecting it to ultraviolet light.

14. A process in accordance with claim 1 wherein the electrostatically bound toner size aggregates formed in step (ii) are from about 0.5 to about 5 microns in volume average diameter.

15. A process in accordance with claim 1 wherein the first pigment is from about 0.01 to about 3 microns in volume average diameter.

16. A process in accordance with claim 1 wherein the toner compositions are isolated subsequent to (iii) and which toner compositions are from about 3 to about 15 microns in volume average diameter, and the geometric size distribution of said toner compositions are from about 1.15 to about 1.35.

17. A process in accordance with claim 16 wherein there is added to the surface of said toner compositions surface additives of metal salts, metal salts of fatty acids, silicas, metal oxides, or mixtures thereof in an amount of from about 0.1 to about 10 weight percent of the obtained toner compositions.

18. A process in accordance with claim 16 wherein said toner compositions are washed with warm water and the surfactants are removed from the toner surface, following by drying.

19. A process in accordance with claim 1 wherein the nonionic surfactant concentration is about 0.1 to about 5 weight percent of the toner composition of resin particles, first pigment and second pigment, and optional charge control agent.

20. A process in accordance with claim 1 wherein the solvent is water.

21. An in situ process for the preparation of fluorescent colored toner particles which comprises mixing a dispersion mixture of fluorescent pigment and colored nonfluorescent pigment, and ionic surfactant with a latex mixture comprised of a counterionic surfactant with a charge of opposite polarity of said ionic surfactant, resin, and nonionic surfactant, which mixing results in flocculation of the pigment mixture and resin; and heating; and wherein the pigment is excitable by ultraviolet light in the frequency range of from about 254 to about 366 nanometers, and fluoresces in the visible spectrum of 400 to 700 nanometers.

22. A process in accordance with claim 21 wherein the fluorescent pigment is 4,4'-bis(styryl)biphenyl, 2-(4-phenylstilben-4-yl)-6-t-butylbenzoxazole, β-methylumbelliferone, 4-methyl-7-dimethylaminocoumarin, 4-methyl-7-aminocoumarin, N-methyl-4-methoxy-1,8-naphthalimide, 9,10-bis(phenethynyl)anthracene, or 5,12-bis(phenethynyl)naphthacene, and the colored nonfluorescent pigment is selected from the group consisting of magnetite, cyan, magenta, and yellow pigments.

23. A process for the preparation of fluorescent toner compositions consisting essentially of (i) preparing a mixed pigment dispersion, which dispersion consists essentially of a fluorescent pigment and a colored pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below the glass transition temperature (Tg) of the resin to form electrostatically bound toner size aggregates; and (iv) heating said bound aggregates above the Tg of the resin and wherein the fluorescent pigment is excitable by ultraviolet light in the frequency range of from about 254 to about 366 nanometers, and fluoresces in the visible spectrum of from about 400 to about 700 nanometers, and wherein the fluorescent pigment is selected from the group consisting of 4,4'-bis(styryl) biphenyl, 2-(4-phenylstilben-4-yl)-6-t-butylbenzoxazole, β-methylumbelliferone, 4-methyl-7-dimethylaminocoumarin, 4-methyl-7-aminocoumarin, N-methyl-4-methoxy-1,8-naphthalimide, 9,10-bis(phenethynyl)anthracene, and 5,12-bis(phenethynyl)naphthacene, and the colored pigment is selected from the group consisting of magnetite, cyan, magenta, and yellow pigments.

24. A process in accordance with claim 23 wherein the temperature below the resin Tg of (iii) enables the size of the aggregated particles to be in the range of from about 2.5 to about 10 microns in volume average diameter.

25. A process in accordance with claim 23 wherein the size of said aggregates can be increased to from about 2.5 to about 10 microns by increasing the temperature of heating in (iii) to from about room temperature to about 50° C.

26. A process for the preparation of fluorescent toner compositions with controlled particle size consisting of (i) preparing a pigment dispersion mixture in water, which dispersion consists of a fluorescent pigment and a visible pigment, and an ionic surfactant;

(ii) shearing the pigment dispersion with a latex blend comprised of resin, a counterionic surfactant with a charge polarity of opposite sign to that of said ionic surfactant and a nonionic surfactant thereby causing a flocculation or heterocoagulation of resin and pigment mixture of a said fluorescent pigment and a said visible pigment to form a uniform dispersion of solids in the water and surfactant;

(iii) heating the above sheared blend at a temperature of from about 5° to about 20° C. below the Tg of the resin to form electrostatically bound toner size aggregates;

(iv) heating the electrostatically bound toner sized aggregates at a temperature of from about 5° to about 50° C. above the Tg of the resin to provide a mechanically stable toner composition comprised of resin, fluorescent pigment and visible pigment; and optionally (v) separating said toner compositions; and (vi) drying said toner compositions, and wherein the fluorescent pigment is excitable by ultraviolet light in the frequency range of from about 254 to about 366 nanometers and fluoresces in the visible spectrum of from about 400 to about 700 nanometers, and wherein the fluorescent pigment is selected from the group consisting of 4,4'-bis(styryl)biphenyl, 2-(4-phenylstilben-4-yl)-6-t-butylbenzoxazole, β-methylumbelliferone, 4-methyl-7-dimethylaminocoumarin, 4-methyl-7-aminocoumarin, N-methyl-4-methoxy-1,8-naphthalimide, 9,10-bis(phenethynyl)anthracene, and 5,12-bis(phenethynyl)naphthacene, and the visible pigment is selected from the group consisting of magnetite, cyan, magenta, and yellow pigments.

27. A process for the preparation of fluorescent toner composition consisting essentially of (i) preparing a pigment dispersion mixture in water, which dispersion consists essentially of a fluorescent pigment and a nonfluorescent colored pigment charge control agent, and an ionic surfactant;

(ii) shearing the pigment dispersion with a latex blend comprised of resin, a counterionic surfactant with a charge polarity of opposite sign to that of said ionic surfactant and a nonionic surfactant thereby causing a flocculation or heterocoagulation of said resin, and said fluorescent pigment and said nonfluorescent pigment, and charge control agent to form a uniform dispersion of solids in the water and surfactant;

(iii) heating the above sheared blend below or equal to the glass transition temperature (Tg) of the resin to form electrostatically bound toner size aggregates;

(iv) heating the electrostatically bound toner size aggregates above or equal to the Tg of the resin to provide a toner composition comprised of resin; followed by optionally (v) separating said toner composition from said water by filtration; and (vi) drying said toner composition, and wherein the fluorescent pigment is excitable by ultraviolet light in the frequency range of 254 to 366 nanometers, and fluoresces in the visible spectrum of 400 to 700 nanometers, and wherein the fluorescent pigment is selected from the group consisting of 4,4'-bis(styryl)biphenyl, 2-(4-phenylstilben-4-yl)-6-t-butylbenzoxazole, β-methylumbelliferone, 4-methyl-7-dimethylaminocoumarin, 4-methyl-7-aminocoumarin, N-methyl-4-methoxy-1,8-naphthalimide, 9,10-bis(phenethynyl)anthracene, and 5,12-bis(phenethynyl)naphthacene, and the colored nonfluorescent pigment is selected from the group consisting of magnetite, cyan, magenta, and yellow pigments.

28. A process in accordance with claim 27 wherein the resin Tg is 54° C. and heating in (iv) is from about 59° C. to about 104° C.

29. A process in accordance with claim 27 wherein the resin Tg in (iii) is from about 52° to about 65° C.

* * * * *